United States Patent [19]

Escaravage

[11] Patent Number: 4,951,979

[45] Date of Patent: Aug. 28, 1990

[54] LATCH, IN PARTICULAR FOR A MOTOR VEHICLE

[75] Inventor: Gerard Escaravage, Valentigney, France

[73] Assignee: Aciers Et Outillage Peugeot, Audincourt, France

[21] Appl. No.: 314,222

[22] Filed: Feb. 21, 1989

Related U.S. Application Data

[63] Continuation of Ser. No. 101,100, Sep. 25, 1987, abandoned.

[30] Foreign Application Priority Data

Sep. 26, 1986 [FR] France ..... 86 13493

[51] Int. Cl.[5] ..... E05C 5/02

[52] U.S. Cl. ..... 292/110; 292/201

[58] Field of Search ..... 292/65, 109, 110, 144, 292/201, DIG. 14

[56] References Cited

U.S. PATENT DOCUMENTS

| | | | |
|---|---|---|---|
| 3,321,226 | 5/1967 | De Claire | 292/65 |
| 3,831,580 | 8/1974 | McLean | 292/109 X |
| 4,597,598 | 7/1986 | Bascou | 292/DIG. 14 X |

*Primary Examiner*—Richard E. Moore

*Attorney, Agent, or Firm*—Sughrue, Mion, Zinn, Macpeak & Seas

[57] ABSTRACT

This latch comprises a case (1) integral with a first part (2) of the vehicle, in which case is disposed a bolt (3), and a keeper (4) integral with a second part (5) of the vehicle and adapted to cooperate with the bolt. The first and second parts of the vehicle are relatively movable and the bolt (3) is mounted to be movable between a position for releasing the keeper and a position for locking the latter in the case (1). The bolt comprises means (6) for hooking the keeper and is mounted to be movable along a path roughly parallel to the path of displacement of the keeper (4) in the vicinity of the case (1), between a position (A) for hooking the keeper, the hooking being achieved by the user shifting the movable part of the vehicle, and the position (B) for locking the keeper, through actuating means (7) actuated in one direction by means detecting the presence of the keeper in the hooking position (A) and, in the other direction, by means detecting the actuation of the bolt unlocking means.

13 Claims, 1 Drawing Sheet

LATCH, IN PARTICULAR FOR A MOTOR VEHICLE

This is a Continuation of application Ser. No. 07/101,100 filed Sept. 25, 1987 (now abandoned).

BACKGROUND OF THE INVENTION

The present invention relates to a latch, in particular for a motor vehicle.

More particularly, the invention concerns a latch of the type comprising a case integral with a first part of the vehicle, and in which is disposed a bolt, and a keeper integral with a second part of the vehicle and adapted to cooperate with said bolt, said first and second parts of the vehicle being movable relative to each other, and the bolt being mounted to be movable between a position for releasing the keeper and a position for locking the latter in the case.

The latches of the prior art have a certain number of drawbacks, in particular as concerns the locking of the keeper by the bolt which requires a large effort resulting for example in the necessity to close the rear door of the vehicle vigourously.

SUMMARY OF THE INVENTION

An object of the invention is therefore to overcome this problem by providing a latch which permits the gentle locking of the keeper in the case, while retaining the effectiveness of the locking and enabling the user to actuate at any moment the means for unlocking the keeper.

The invention therefore provides a latch of the type described hereinbefore, wherein the bolt comprises means for hooking the keeper and is mounted to be movable along a path roughly parallel to the path of the displacement of the keeper in the vicinity of the case, between a keeper hooking position, the hooking being achieved by the shifting of said movable part of the vehicle by the user and the keeper locking position by actuating means controlled in one direction by means detecting the presence of the keeper in the hooking position and in the other direction by means detecting the actuation of the bolt unlocking means.

Advantageously, the hooking means comprise a hook which is movable between an active position, to which it is elastically biased and in which it extends into the path of the displacement of the keeper, and a retracted position for permitting the hooking or the release of the keeper.

BRIEF DESCRIPTION OF THE DRAWING

A better understanding of the invention will be had from the following description which is given solely by way of example with reference to the accompanying drawing, in which.

DETAILED DESCRIPTION OF A PREFERRED EMBODIMENT

Figure 1:
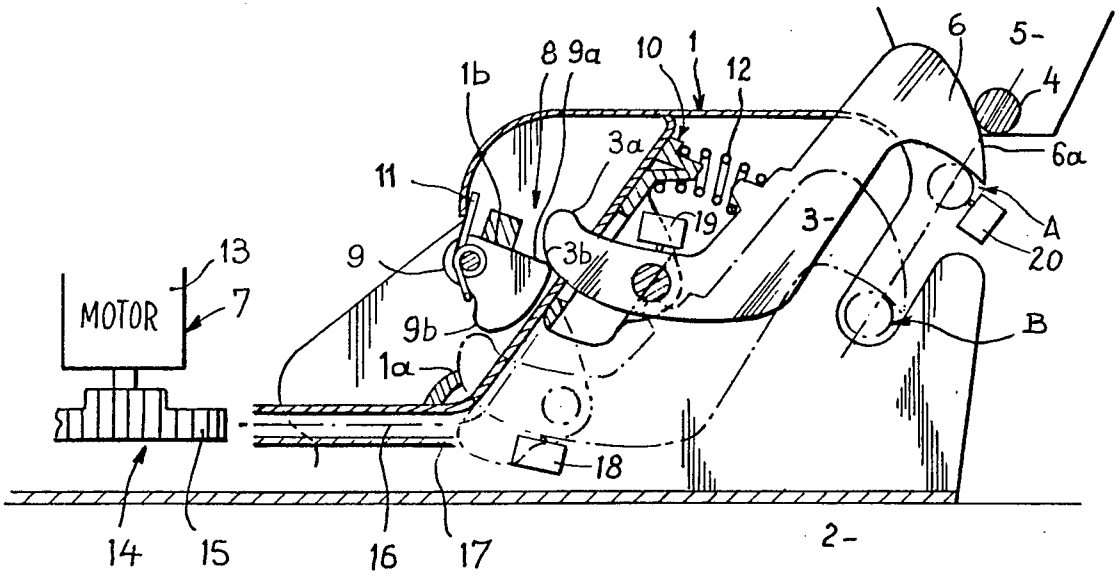
FIG. 1 represents a sectional view of a latch according to the one embodiment of invention, the keeper being shown in several of its positions.

As has been shown in FIG. 1 of this drawing, a latch according to the invention for a motor vehicle comprises a case 1 mounted on a first part 2 of the vehicle and in which is disposed a bolt 3. The latch further comprises a keeper 4 adapted to cooperate with the bolt and mounted on a second part 5 (e.g. door) of the vehicle, for example mounted to be movable relative to the first part 2 of the vehicle, and movable by the user.

The bolt 3 comprises keeper hooking means 6 and is mounted to be movable along a path which is roughly parallel to the path of the displacement of the keeper in the vicinity of the case, between a keeper hooking position, illustrated by the arrow A in said Figure, the hooking being achieved by a shifting of said movable part of the vehicle by the user, and a keeper locking position, illustrated by the arrow B by actuating means 7 operated in one direction, i.e. from the hooking position A to the locking position B, by means detecting the presence of the keeper in the hooking position.

These detecting means are, for example, constituted by a switch 20 actuated by the keeper or the bolt when the keeper reaches the position in which it has just been hooked by the hooking means 6, as shown in FIG. 1. An unlocking switch (not shown), actuated by the user when he desires to unlock the latch, causes operation of the actuating means in the opposite direction. A switch 21 actuated by the user when he desires.

Note moreover that end-of-travel switches 18 and 19 are provided in the bolt hooking position A and locking position B, respectively, for cutting off the supply of power to the actuating means 7 and stop the displacement of the bolt.

The hooking means 6 comprise a hook which is movable between a first or active position to which it is elastically biased and in which it extends into the path of displacement of the keeper, and a second or retracted position for permitting the unhooking or the release of the keeper.

The hook 6 has for example an inclined camming surface *6a*, with which cooperates the keeper 4 for shifting the hook to its retracted position upon the hooking of the keeper.

Means 8 for retracting the bolt from the keeper 4 upon actuation of the bolt unlocking means are also provided. These means will be described in more detail hereinafter.

The bolt 3 has a generally S shape. One of the ends of this bolt includes the aforementioned hooking means 6 and its central portion is pivotally mounted on a slide or support 10 which is movable in the case 1 by the actuating means 7 so as to cause the bolt to be displaced between its two positions.

At the other of its ends, the bolt has bearing surfaces *3a*, *3b* adapted to cooperate with a first abutment surface *1a* of the case and the aforementioned retracting means 8 for locking the bolt in the locking position and retracting it upon its return to the hooking position respectively.

For this purpose, the retracting means 8 comprise an abutment element 9 pivotally mounted in the case to move between an active position to which it is elastically biased and a retracted position. This abutment element has bearing surfaces *9a*, *9b* adapted to cooperate with the bearing surfaces *3a*, *3b* of the bolt for shifting the abutment element to its retracted position when the bolt moves towards its locking position in opposition to the action of elastically yieldable means 11 which biases the abutment element to its active position. Thus, when the bolt is shifted from its hooking position A to its locking position B, the corresponding end of the bolt causes the abutment element to retract until this end of the bolt has completely passed beyond the abutment element. The latter then returns to its active position. In this position, the abutment element bears against a second abutment surface 1b of the case, and the first abutment surface 1a of the latter locks the bolt in the locking position.

When the actuating means 7 are operated in such manner as to ensure a displacement of the bolt 3 from the locking position B to the hooking position A, the corresponding end of the bolt, and more particularly the bearing surface 3a of the latter, bears against the support surface 9b of the abutment element whose support surface 9a is itself bearing against the abutment surface 1b of the case. The bolt is then caused to swing about its pivot axis in such manner as to retract from and release the keeper. As soon as this abutment element has been passed through, the corresponding end of the bolt is then released and the bolt returns to its active hooking position under the action of the elastically yieldable means biasing it to this position. For this purpose, it should be noted that this bolt is elastically biased to its active position by a spring 12 having one end bearing against the slide 10 and the other end against the bolt 3.

The aforementioned actuating means 7 comprises, for example, a motor/speed-reducer 13 whose output shaft cooperates with driving means 14 constituted, for example, by an irreversible worm and worm wheel system 15 connected to a driving strip 16 mounted to be movable in a slideway 17 mounted on the case and having one end connected to the slide 10. Also note that the slide 10 is movably mounted in this slideway 17.

It will be understood that other embodiments are possible. Thus, for example, the driving strip 16 may be dispensed with in the case where there is used a driving system including a link and crank connected to the slide 10 and to the motor speed-reducer unit 13 to ensure the shifting of the slide carrying the bolt 3. This permits the use of a motor.

The latch according to the invention:

When the user shifts the movable part of the vehicle on which the keeper is mounted to the hooking position A, this keeper 4 cooperates with the inclined surface 6a of the means 6 for hooking the bolt 3 so as to shift the latter to its retracted position and permit the keeper to pass beyond the hooking means and reach the hooking position A.

In this position, the means detecting the presence of the keeper in the hooking position supply power to the motor speed-reducer 13 in a certain direction so that the latter results in the displacement of the driving strip 16, and therefore of the slide 10 and the bolt 3, to the position B in which the bolt locks the keeper.

Upon this displacement, the corresponding end of the bolt constrains the abutment element 9 to retract until the end has passed beyond this element.

In the keeper locking position B, the supply of power to the motor speed-reducer unit is cut off by the corresponding end-of-travel switch 18 and the corresponding end of the bolt is then disposed below the abutment element where it bears against the first abutment surface 1a of the case, which prevents the bolt from pivoting, bearing in mind that the irreversible worm and worm wheel system locks the slide in position.

When the user desires to unlock the keeper, he actuates the unlocking switch which supplies power to the motor speed-reducer unit in such manner that the slide, and therefore the bolt, are shifted to the hooking position A. Upon this displacement, the corresponding end of the bolt comes to bear against the abutment element which is itself bearing against the second abutment 1b of the case, which causes the bolt to pivot to its retracted position for releasing the keeper. The displacement of the bolt continues so long as its corresponding end has not completely passed beyond the abutment element and the end-of-travel switch 19 detecting the presence of the bolt in the keeper hooking position has not been actuated. When the latter is actuated, it cuts off the supply of power to the motor speed-reducer unit and stops the displacement of the bolt which is then ready for another locking cycle.

In the description, the various detecting and end-of-travel switches have been only schematically illustrated and have not been described in detail since these types of switches are well known in the art and present no particular difficulty as concerns their use.

Thus, the latch according to the invention permits a gentle locking of the keeper, the bolt ensuring an automatic locking of the keeper.

What is claimed is:

1. A latch assembly comprising in combination a first part and a second part of in particular a motor vehicle, which parts are relatively movable in a first path, and a latch for latching said parts, said latch comprising a case mounted on said first part, a keeper mounted on said second part so that said keeper and said case are relatively movable toward and away from each other in said first path, a support movably mounted in said case, a bolt movably mounted on said support and defining keeper hooking means, said support being movable relative to said case in a second path substantially parallel to said first path between a first position in which said keeper hooking means is capable of encountering said keeper upon said relative movement of said first part and said second part, and a second position in which said keeper is hooked in said case by said hooking means, actuating means connected to said support for shifting said support between said first position and said second position of said support, said actuating means comprising an electric motor, a power supply, conductors connecting said power supply to said motor, a first switch and a second switch inserted in said conductors, said first switch being operative to cause supply of power to the motor for automatically shifting said support from said first position to said second position of said support and said second switch being operative for supplying, when desired, power to said motor for shifting said support from said second position to said first position for releasing said keeper, said bolt being movable relative to said support transversely of said second path between an active position in which said keeper hooking means is located in said first path and a retracted position in which said keeper hooking means is retracted from said first path, said keeper hooking means defining a cam surface which is engageable by said keeper in said active position of said bolt and in said first position of said support and is operative to shift said bolt to said retracted position to permit hooking onto said keeper upon engagement with said cam surface, elastically yieldable means associated with said bolt for elastically biasing said bolt to said active position of said bolt, means for detecting the position of said keeper upon said hooking of said keeper by said keeper hooking means and associated with said first switch for actuating said first switch and automatically causing operation of said actuating means and thereby causing said support to be shifted to said second position of said support and locking said keeper in position by said keeper hooking means, and bolt retracting means which is positioned in said case to be engaged by said bolt for retracting said bolt from said active position to said retracted position of said bolt when said support is shifted from said second position toward said first position of said support, but is disengageable from said bolt and allows said bolt to resume said active position under the action of said elastically yieldable means before said support reaches said first position of said support, said retracting means allowing the undisturbed passage of said bolt and therefore being incapable of retracting said bolt when said support is shifted from said first position to said second position of said support.

2. A latch assembly according to claim 1, wherein said bolt is pivotally mounted on said support and said hooking means comprise a hook-shaped end portion of said bolt which also defines said cam surface.

3. A latch assembly according to claim 2, wherein said retracting means comprises an abutment element pivotally mounted in said case to pivot between an active position of abutment against said case and a retracted position, elastically yieldable means associated with said abutment element for biasing said abutment element to said active position of abutment thereof, said abutment element having a first abutment surface and a second abutment surface and said bolt having a first bearing surface and a second bearing surface respectively for cooperation with said abutment surfaces of said abutment element for pivoting said abutment element from said active position to said retracted position of said abutment element upon a displacement of said support from said first position to said second position of said support, said abutment element in said active position thereof being engageable by said bolt for pivoting said bolt to said retracted position of said bolt in a first part of the shifting of said support from said second position to said first position of said support, said bolt being disengageable from said abutment element in a last part of said shifting of said support from said second position to said first position of said support for resuming said active position of said bolt under the action of said elastically yieldable means for biasing said bolt.

4. A latch assembly according to claim 3, wherein said bolt has the general shape of an S defining said hook-shaped end portion and a central portion, said support being a slide slidably mounted in said case, said central portion of said bolt being pivotally mounted on said slide, said bolt having a second end portion remote from said hook-shaped end portion and defining said two bearing surfaces adapted to cooperate with said abutment surfaces of said abutment element, said case defining an abutment surface with which said second end portion of said bolt is engageable in said second position of said support for preventing a pivoting of said bolt and thereby locking said bolt in said active position.

5. A latch according to claim 4, wherein said elastically yieldable means for biasing said bolt to said active position thereof is a spring having one end in bearing relation to said slide and an opposite end in bearing relation to said bolt.

6. A latch assembly according to claim 1, wherein said actuating means comprise a speed reducer drivenly connected to said motor and having an output shaft, and driving means drivingly connecting said output shaft to said support for shifting said support between said first and second positions of said support.

7. A latch assembly according to claim 6 wherein said driving means comprise a slideway integral with said case, a driving strip mounted to be movable in said slideway and having an end connected to said support, and an irreversible worm and worm wheel system cooperative with said driving strip and drivenly connected to said speed reducer.

8. A latch assembly according to claim 6, wherein said support is a slide and said driving means comprise a crank and connecting rod system, a slideway integral with said case in which said slide is slidably mounted, said crank and connecting rod system being connected to said slide for shifting said slide in said slideway between said first and second positions of said slide.

9. A latch assembly according to claim 1, wherein said means for detecting the presence of said keeper in said hooking position comprise said first switch which is actuatable by an element of two elements consisting of said keeper and said bolt upon the hooking of said keeper by said hooking means.

10. A latch assembly according to claim 1, wherein said second switch is actuatable by the user when the user desires to unlock said keeper electrically by shifting said support to said first position of said support.

11. A latch assembly according to claim 1, comprising end-of-travel switches inserted in said conductors and positioned to be actuated by said bolt in said first position and said second position of said support for cutting off the supply of power to said motor-operated actuating means.

12. A latch assembly according to claim 1, wherein said retracting means is so positioned in said case that it is engageable by said bolt for retracting said bolt substantially as soon as said support is shifted from said second position whereby to release said keeper from said means substantially without delay.

13. A latch assembly according to claim 1 wherein there is provided in said case abutment means against which said bolt abuts in said second position of said support and is prevented by said abutment means from moving toward said retracted position so long as said support is not shifted toward said first position by said motor.

* * * * *